US007283775B2

(12) United States Patent
Kamimura et al.

(10) Patent No.: US 7,283,775 B2
(45) Date of Patent: Oct. 16, 2007

(54) DEVELOPING DEVICE USING SPECIFIC CHARGING UNIT FOR CHARGING TONER AND IMAGE FORMING DEVICE ADOPTING THE SAME

(75) Inventors: Taisuke Kamimura, Kitakatsuragi-gun (JP); Kiyoshi Toizumi, Nara (JP); Toshimitsu Gotoh, Sumida-ku (JP)

(73) Assignee: Sharp Kabushiki Kaisha, Osaka (JP)

( * ) Notice: Subject to any disclaimer, the term of this patent is extended or adjusted under 35 U.S.C. 154(b) by 327 days.

(21) Appl. No.: 10/536,717

(22) PCT Filed: Nov. 21, 2003

(86) PCT No.: PCT/JP03/14867

§ 371 (c)(1),
(2), (4) Date: May 26, 2005

(87) PCT Pub. No.: WO2004/049077

PCT Pub. Date: Jun. 10, 2004

(65) Prior Publication Data

US 2006/0133859 A1 Jun. 22, 2006

(30) Foreign Application Priority Data

Nov. 27, 2002 (JP) ..... 2002-344534

(51) Int. Cl.
*G03G 15/08* (2006.01)

(52) U.S. Cl. ..... 399/281; 399/284

(58) Field of Classification Search ..... 399/252, 399/253, 279, 281, 284; 347/140, 158; 430/120.1; 361/226

See application file for complete search history.

(56) References Cited

U.S. PATENT DOCUMENTS

| | | | | |
|---|---|---|---|---|
| 3,645,614 | A * | 2/1972 | McFarlane et al. | 399/135 |
| 3,787,876 | A * | 1/1974 | Pressman et al. | 347/55 |
| 6,438,346 | B2 * | 8/2002 | Kamimura et al. | 399/281 |
| 6,600,892 | B2 * | 7/2003 | Kamimura et al. | 399/281 |
| 6,829,446 | B2 * | 12/2004 | Toizumi et al. | 399/53 |
| 6,865,350 | B2 * | 3/2005 | Kamimura et al. | 399/53 |
| 2002/0001486 | A1 | 1/2002 | Kamimura et al. | |

FOREIGN PATENT DOCUMENTS

| | | |
|---|---|---|
| EP | 1 248 160 A1 | 10/2002 |
| JP | 08-101527 | 4/1996 |

* cited by examiner

*Primary Examiner*—Robert Beatty
(74) *Attorney, Agent, or Firm*—George W. Neuner; David G. Conlin; Edwards Angell Palmer & Dodge LLP

(57) ABSTRACT

A developing device prevents deterioration of toner, i.e., prevent the toner from being damaged, or fused onto the blade, to realize a more reliable developing operation. In the developing device, an electron emitting section is provided onto the toner regulation blade in which apertures (151) are formed, wherein each of the apertures (151) is formed by electroforming to have an inner surface curved convexly to be widened outwardly to the side irradiated with an ultraviolet ray (shape A). Further, a photoelectric surface (152) is laminated on the surface of the electron emitting section with the apertures (151). With an application of ultraviolet ray onto the electron emitting section, the resulting photoelectrons as emitted from the photoelectric surface (152) are guided to the toner through the apertures (151). Here, for the aperture (151) of the shape A, a larger amount of electrons can be guided to the toner than the apertures in other shapes (B to E).

9 Claims, 7 Drawing Sheets

SHAPE A

SHAPE B

SHAPE C

SHAPE D

SHAPE E

DEVELOPING DEVICE USING SPECIFIC CHARGING UNIT FOR CHARGING TONER AND IMAGE FORMING DEVICE ADOPTING THE SAME

TECHNICAL FIELD

The present invention relates to a developing device for use in a copying machine, a printing machine, a facsimile or other electro-photographic apparatus.

BACKGROUND ART

A developing device adopted in a copying machine, a printing machine, a facsimile, or other electro-photographic apparatus is generally arranged such that toner is supplied to a photoreceptor which carries an electrostatic latent image formed on a surface thereof, to develop (visualize) the electrostatic latent image into a toner image. Specifically, in such developing device, toner is sequentially supplied onto a surface of the developing roller in a circumferential direction by a supply roller, and the toner held on the developing roller is carried onto the photoreceptor by the rotations of the developing roller.

A toner layer formed on the developing roller is regulated by a blade provided on the downstream side of the supply roller in the rotation direction of the developing roller. At the same time, the toner is charged by friction with the blade (friction charge). The charged toner held on the developing roller is then carried to a section facing the photoreceptor provided on the further downstream side in the rotation direction by the developing roller to be supplied electrostatically to the electrostatic latent image formed on the surface of the photoreceptor, thereby developing (visualizing) the electrostatic latent image into a toner image. The resulting visualized toner image is transferred to a recording material by the transfer means, and is then permanently affixed onto the recording material with an application of heat and pressure by the fixing means.

Japanese Laid-Open Patent Publication 7-281473/1995 (Tokukaihei 7-281473/1995), published on Oct. 27, 1995), Japanese Laid-Open Patent Publication 7-295327/1995 (Tokukaihei 7-295327/1995), published on Nov. 10, 1995), and Japanese Laid-Open Patent Publication 9-6132/1997 (Tokukaihei 9-6132/1997), published on Jan. 10, 1997) disclose the method of charging toner containing photo chromic compounds etc., which are reactive to light having a unique wavelength, wherein the toner is charged as being by directly irradiated with light in the developing device.

Japanese Laid-Open Patent Publication 4-220657/1992 (Tokukaihei 4-220657/1992), published on Aug. 11, 1992, and Japanese Laid-Open Patent Publication 7-234536/1995 (Tokukaihei 7-234536/1995), published on Sep. 5, 1995) disclose the method of charging toner by utilizing the photo-chromic reaction with an application of light onto the toner.

According to the foregoing conventional structure of charging toner, the blade for regulating the thickness of a toner layer is used also for charging the toner by friction. Namely, according to the foregoing conventional structure wherein the toner is charged by the friction with the blade, it is necessary to make the blade in tight contact with the developing roller with an applied relatively strong contact pressure (F) to charge the toner to a predetermined amount of charge. As described, in the foregoing conventional structure, since a high contact pressure is applied to the toner by the blade, it is liable that the toner be damaged by the applied contact pressure.

For the energy budget in the friction charging method, the following can be said. The driving energy (Ek) of the developing roller is converted into the toner layer thickness regulating energy (Es) and the toner charging energy (Et) by the function of the blade. Here, a part of the driving energy (Ek) is consumed as a thermal loss energy (El). Here, depending on the resulting thermal loss energy (El), a problem may arise in that the toner is made softer which expedites such problem that the toner is damaged or fused onto the surface of the blade, which deteriorates the characteristic of the toner being charged by friction.

On the other hand, when adopting the method of charging toner containing the special photo chromic compounds by irradiating the toner with light, it becomes difficult to adjust toner components due to the photo chromic material contained in the toner. It is therefore desirable not to adopt such toner whose components are difficult to be adjusted.

Particularly, in recent years, development has been made to achieve improved toner in terms of energy conservation. Specifically, for example, an attempt has been made to reduce the fixing energy by lowering the softening temperature of toner, or to improve the tinting power by increasing the number of toner pigment sections (reducing the breaking resistance of the toner). However, such toner is not suitably applied in the conventional friction charging method as strong contact pressure or heavy thermal load is applied to the toner.

The present invention is achieved in view of the foregoing problems associated with the conventional toner charging method, and it is therefore an object of the present invention to provide a developing device which can prevent deterioration of toner, i.e., prevent the toner from being damaged, or fused onto the blade, to realize a more reliable developing operation, and particularly to provide a developing device which can adopt such toner with a lower softening temperature, or toner containing an increased number of pigments to improve the tinting power.

SUMMARY OF THE INVENTION

In order to achieve the foregoing object, the developing device of the present invention which comprises charging means for charging a target material, wherein said target material as charged by said charging means is supplied onto an electrostatic latent image to develop said electrostatic latent image into a toner image, is characterized in that:

said charging means comprises:

light irradiation means for irradiating light; and photoelectron emission means, provided between said light irradiation means and said target material, for emitting photoelectrons when receiving light irradiated from said light irradiation means, wherein a through-type aperture is formed through said photoelectron emission means from the side of said light irradiation means to the side of said target material; and said through-type aperture is shaped to have its inner surface curved convexly to be widened outwardly to the side of said light irradiation means, and photoelectrons are emitted from the inner surface when receiving light from said light irradiation means.

According to the developing device of the present invention, when receiving light from the light irradiation means to the photoelectron emission means, photoelectrons are emitted from the photoelectron emission means. Here, as the through-type aperture is shaped to have its inner surface curved convexly to be widened outwardly to the side of said light irradiation means, a light receiving area of the inner surface can be increased, and it is therefore possible to emit a larger amount of photoelectrons. Moreover, photoelectrons as emitted from the inner surface, which pass through the apertures, can be effectively carried onto the target material to be charged. As a result, the target material can be charged under stable conditions, thereby obtaining a desirable image.

According to the foregoing structure, the mechanical charge of the toner such as friction charge as required in the conventional method can be omitted, and it is therefore possible to charge the toner without an applied stress such as thermal load, etc. It is also possible to sufficiently charge the generally used toner by irradiating the toner with light, other than the toner of the special structure including photochromic compounds.

As a result, the developing device offers the effect of preventing toner from deteriorating, i.e., preventing the toner form being damaged, or fused onto the blade, and such developing device which ensures an improved reliability in the developing process is also applicable to the toner whose melting point is lowered for the purpose of reducing fixing energy, or the toner having an increased number of pigment sections to improve the tinting power.

In order to achieve the foregoing object, the developing device of the present invention is characterized in that:

the inner surface of said through-type aperture is curved convexly to have a cross section of an arc shape when cut along a line which is parallel to a through direction of said through-type aperture and which passes through a center of said through-type aperture.

According to the foregoing structure, as the inner surface of the through-type aperture is curved convexly to have a cross section of an arc shape, a larger amount of photoelectrons can be emitted from the inner surface of the aperture, and by the effect of an electric field generated around the circumference, the photoelectron as emitted can be effectively guided to the target material.

In order to achieve the above object, the developing device of the present invention having the foregoing structure may be further arranged such that a radius of said arc of said cross-section is not shorter than a distance from one end of said through-type aperture to the other end of said through-type aperture.

According to the foregoing structure, a radius of said arc of said cross-section is not shorter than a distance from one end of said through-type aperture to the other end of said through-type aperture, i.e., the size of the aperture in the through direction of the through-type aperture, it is possible to form the aperture by the electroforming.

In order to achieve the foregoing object, the developing device having the foregoing structure of the present invention is characterized in that:

said through-type aperture is formed by electroforming.

When forming the apertures by the electroforming process, it is possible to form the inner surface of each aperture to have its inner surface curved convexly to be widened outwardly to one side without difficulty. Furthermore, in the case of forming a plurality of apertures in the electron emitting means, it is possible to make the apertures to have respective inner surfaces uniformly curved convexly among the apertures, which offers the effect of uniformly charging the target material, thereby obtaining a desirable image.

In order to achieve the foregoing object, the developing device of the present invention having the foregoing structure is characterized in that:

said photoelectron emission means is made of nickel or an alloy of nickel and cobalt.

According to the foregoing structure, by adopting nickel or an alloy of nickel and cobalt for the material of the photoelectron emission means, it is possible to perform the electroforming with high precision by adopting the above material for the photoelectron emission means. Incidentally, by adopting the above material for the aperture, it is possible to perform the electroforming uniformly among the plurality of apertures, and it is therefore possible to uniformly emit photoelectrons, thereby forming a uniform image without having uneven parts.

In order to achieve the foregoing object, the developing device having the foregoing structure of the present invention is characterized in that:

a photoelectric film, which emits photoelectrons when receiving light irradiated from said light irradiation means, is formed at least on one of the surfaces of said photoelectron emission means, on the side facing said light irradiation means.

According to the foregoing structure, by forming the photoelectric film at least on one of the surfaces of said photoelectron emission means, on the side facing the light irradiation means, with an application of light emitted from the light irradiation means, the photoelectric effect can be appreciated efficiently. It is therefore possible to supply sufficient amount of electrons to the target material, thereby charging the target material to a sufficient amount of charge required for forming a desirable image.

In order to achieve the foregoing object, the developing device of the present invention is characterized in that:

said photoelectric film is made of noble metal, a compound of noble metals or a compound of noble metal and base metal.

The photoelectric film can be formed by any material of noble metal, a compound of noble metals or a compound of noble metal and base metal. Furthermore, by adopting a compound of noble metal and base metal, it is possible to emit a larger amount of electrons by the effect of the base metal of low work function, and it is also possible to emit electrons under stable conditions for a longer period of time by the effect of the noble metal of low reactivity in the atmosphere.

In order to achieve the foregoing object, the developing device of the present invention is characterized in that:

said noble metal is gold, silver or platinum, and the base metal is copper, palladium or nickel.

According to the foregoing structure, metals can be combined without difficulty, and a molecular bonding can be surely performed which offers such effect that it is less likely that the material changes over time and a larger amount of electrons can be emitted under stable conditions.

In order to achieve the foregoing object, the image forming apparatus of the present invention is characterized by being provided with any of the foregoing developing device of the present invention.

According to the foregoing structure, with the effect of the developing device which can perform the charging operation under stable condition, a desirable image forming operation can be performed.

BEST MODE FOR CARRYING OUT THE INVENTION

First Embodiment

The following descriptions will explain one embodiment of the present invention in reference to FIG. 1 through FIG. 5.

The schematic structure of an electro-photographic apparatus (image forming apparatus) provided with a developing device in accordance with one embodiment of the present invention will be explained in reference to FIG. 4.

Figure 4:
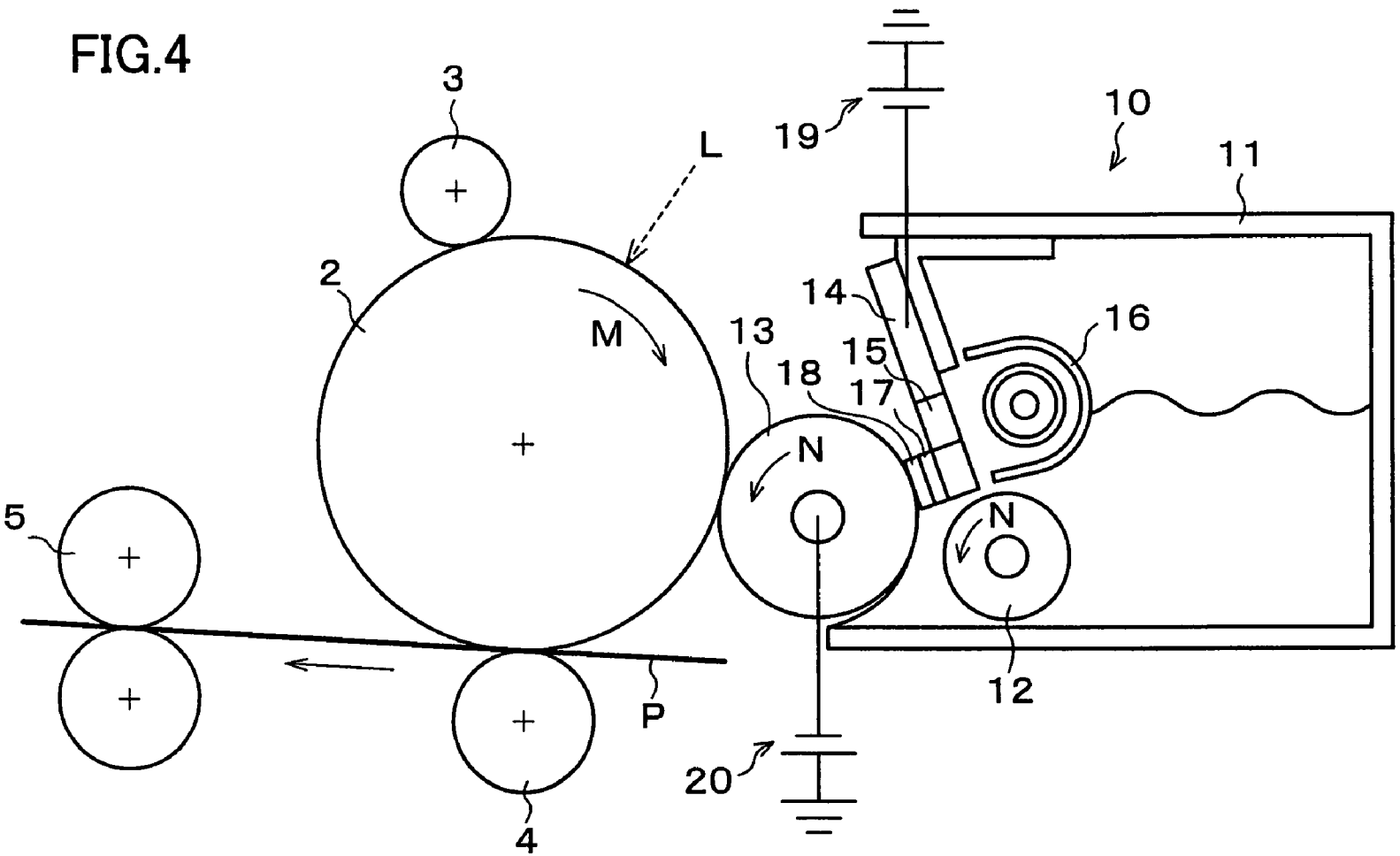
FIG. 4 is a cross-sectional view schematically showing the structure of the image forming apparatus provided with the developing device in accordance with the first embodiment of the present invention.

As illustrated in FIG. 4, a developing device 10 is provided so as to face a photoreceptor drum 2. This developing device 10 develops an electrostatic latent image formed on a surface of the photoreceptor drum 2 using developing material (target material to be charged) made of a non-magnetic single-component toner. The developing device 10 includes a developer vessel 11 (container) for storing toner, a supply roller 12, a developing roller 13 and a regulation blade 14 for regulating toner layer thickness.

The supply roller 12 is provided inside the developing device 10, and this developing roller 12 rotates in such a manner that respective outer circumferences of the supply roller 12 and the developing roller 13 face one another, so as to supply toner onto the outer circumference of the developing roller 13. The developing roller 13 is provided facing the photoreceptor drum 2 in the developing device 10 so as to be rotatable, and by the rotations of this developing roller 13, the toner as supplied by the supply roller 12 is carried onto the photoreceptor drum 2. The regulation blade 14 for regulating toner layer thickness is provided on the downstream side of the supply roller and the upstream side of the photoreceptor drum 2 in the rotating direction of the developing roller 13 so as to contact the developing roller 13 to regulate the thickness of the toner layer formed on the surface of the developing roller 13.

The developing device 10 also includes an electron emitting section (photoelectron emission means) 15 and an ultraviolet ray irradiator (light irradiation means) 16 for irradiating the electron charging section 15 with an ultraviolet ray. These electron emitting section 15 and the ultraviolet ray irradiator 16 constitute toner charging section (charging means) for charging the toner to be supplied to the photoreceptor drum 2 to a predetermined amount of charge. This toner charging section will be explained in detail later.

The process section in the electro-photographic apparatus provided with the developing device 10 will be briefly explained.

As illustrated in FIG. 4, the process section is mainly made up of a photoreceptor drum 2, a charging roller 3, an exposure section (not shown), a developing device 10, a transfer-use discharging roller 4, a cleaning section (not shown), a charge removing section (not shown), and a pair of fixing rollers 5. In FIG. 4, P indicates a recording sheet, and L indicates a light beam emitted from the exposing section, for use in writing the electrostatic latent image onto the surface of photoreceptor drum 2.

The photoreceptor drum 2 rotates in a predetermined direction (in a direction of an arrow M in FIG. 4), and first the external circumferential surface thereof is uniformly charged by the charging roller 3. Then, a light beam L which is to be adjusted according to the image data by the exposing section is applied onto the uniformly charged surface of the photoreceptor drum 2, thereby forming an electrostatic latent image to be held on the surface thereof.

The electrostatic latent image formed on the photoreceptor drum 2 is carried to a position facing the developing device 10 by the rotations of the photoreceptor drum 2, and with a supply of toner by the developing device 10, the electrostatic latent image is visualized (a toner image is formed on the photoreceptor drum 2). In this state, the developing roller 13 in the developing device 10, which carries the toner on the surface thereof, rotates in a predetermined direction (in a direction of an arrow N in FIG. 4) to carry the toner onto the photoreceptor drum 2.

In the present embodiment, the photoreceptor drum 2 is made up of an organic photoconductor. The photoreceptor drum 2 is charged to −700 V (amount of charge by the charging roller 3), and rotates at peripheral velocity of 50 mm/s in the direction of an arrow M in FIG. 4. The developing roller 13 has a cylindrical shape and is made of an electrically conductive rubber elastic material. With an application of a developing bias of −400V, the developing roller 13 rotates in the direction of an arrow N at the same peripheral velocity as the photoreceptor drum 2. The supply roller 12 has a cylindrical shape and is made of an electrically conductive rubber elastic material. This supply roller 12 rotates in a direction of an arrow N at the same peripheral velocity as the photoreceptor drum 2.

The toner image as developed on the surface of the photoreceptor drum 2 is transferred onto the sheet P. On the down stream side of the transfer-use discharging roller 4 in the rotating direction of the photoreceptor drum 2, further provided are the cleaning section and the charge removing section. This cleaning section removes residual toner remaining on the surface of the photoreceptor drum 2 after the toner image has been transferred. The charge removing section removes charges from the surface of the photoreceptor drum 2. The sheet P having the toner image transferred on the surface thereof is transported in a space between the fixing rollers 5. Here, while the sheet P is being passed between the pair of fixing rollers 5, heat and pressure are applied from above and below as being sandwiched by the pair of fixing rollers 5, whereby the toner image is permanently affixed onto the sheet P.

Next, the developing process in the developing device 10 will be explained in detail.

Figure 5:
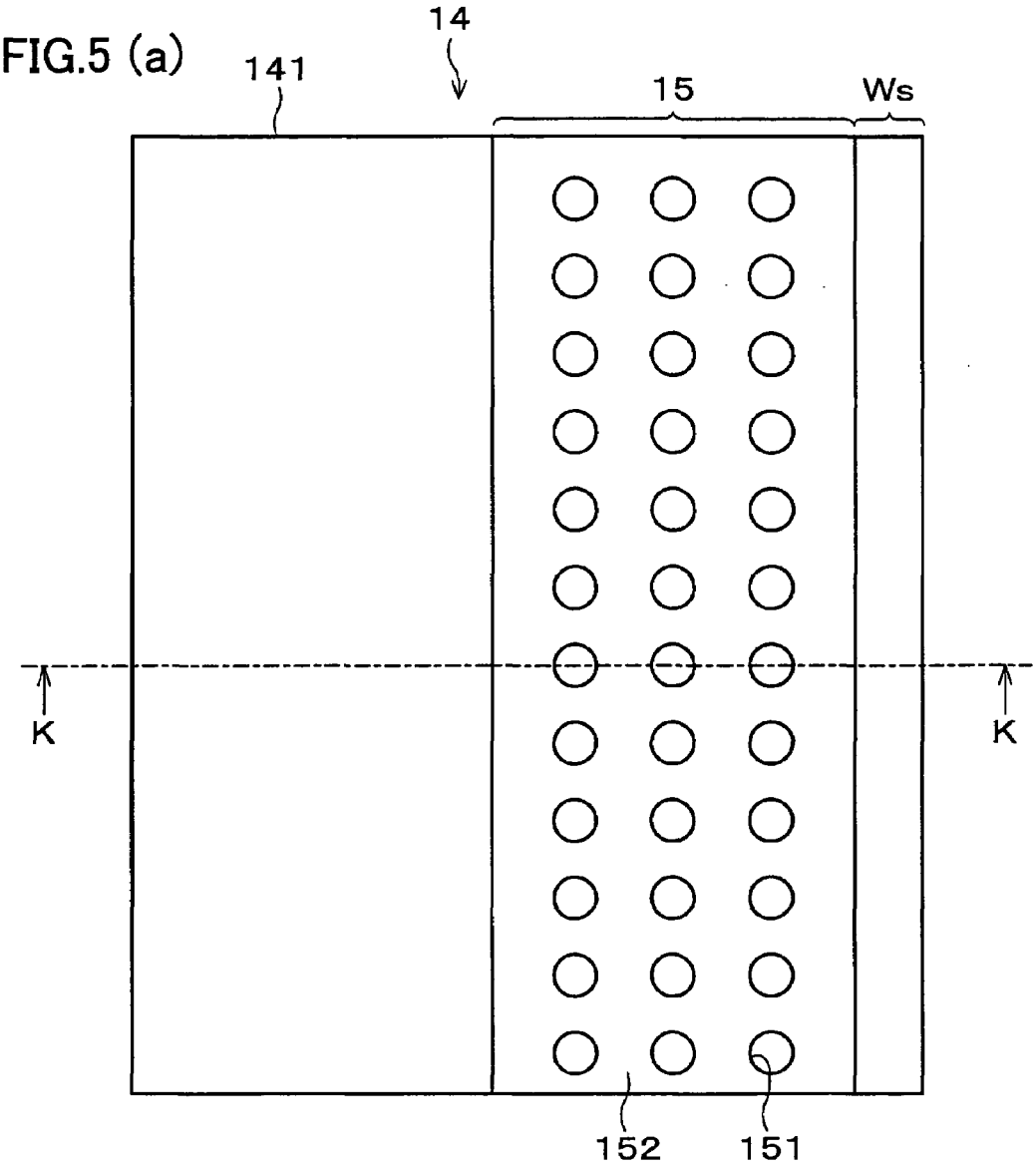
FIG. 5(*a*) and FIG. 5(*b*) show the structure of the regulation blade for regulating toner layer thickness adopted in the developing device of FIG. 4, wherein FIG. 5(*a*) is a plan view, and FIG. 5(*b*) is a cross-sectional view taken along a line K-K of FIG. 5(*a*).
Figure 5:
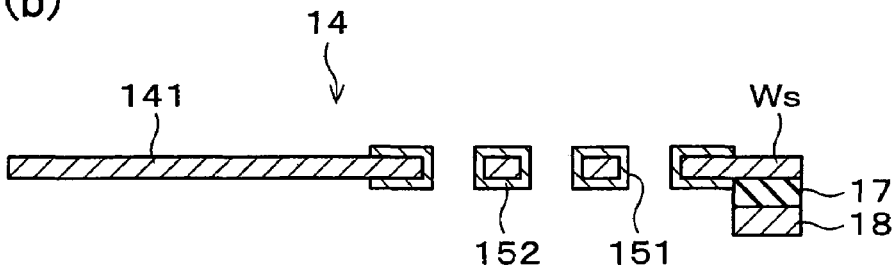

As described, in the developing device 10, the toner is sequentially supplied by the supply roller 12 onto the surface of the developing roller 13, and the developing roller 13 rotates with the toner held on its surface. As a result, the toner held on the developing roller 13 is carried to a contact region Ws between the developing roller 13 and the regulation blade 14 for regulating toner layer thickness, and the thickness of the toner layer formed on the developing roller 13 is then regulated by the regulation blade 14. As shown in FIG. 5(*a*), this contact region Ws is provided at the leading end of the regulation blade 14 for regulating toner layer thickness.

The toner layer formed on the developing roller 13, which has been subjected to the regulation of the layer thickness by the regulation blade 14 for regulating toner layer thickness receive charges from the electron emitting section 15 and the ultraviolet irradiator 16 which constitute the toner charging section, thereby charging the toner to a sufficient amount of charge for developing. By irradiating the electron emitting section 15 formed on the restricting blade 14 with an ultraviolet ray emitted from the ultraviolet ray irradiator 16, photoelectrons are inducted from the electron discharging section 15 by the photoelectric effect. The resulting photoelectrons are then emitted to the toner formed on the surface of the developing roller 13 to be charged to a predetermined amount of charge. Incidentally, it is preferable that the ultraviolet irradiator 16 emits light in sync with rotations of the developing roller 13, as unnecessary emission of light which increases power consumption can be suppressed. It is also preferable that the space (not shown) between the electron emitting section 15 and the ultraviolet irradiator 16 be sealed so as to prevent the toner from entering into the space, which hinders the irradiation of light.

In the toner charging section of the foregoing structure, the electron emitting section 15 is provided at different position from the contact region Ws on the regulation blade 14 for regulating toner layer thickness, and the electron emitting section 15 is not in contact with the toner formed on the developing roller 13. It is therefore possible to charge the toner without an applied load. Therefore, in the developing device 10, it is only required for the regulation blade 14 for regulating toner layer thickness to contact the developing roller 13 with an applied contact pressure required for regulating the thickness of the toner layer. It is therefore possible to significantly reduce the contact pressure and the thermal load applied to the toner by the regulation blade 14 for regulating toner layer thickness.

Incidentally, the electron emitting section forming area is completely separated from the developing roller 13, and the toner layer can be formed without being affected by the surface roughness of the electron emitting section 15, and the limitation on design due to the surface roughness of the electron emitting section 15 can be avoided.

The resulting toner as charged to a predetermined amount of charge by the toner charging section is carried to the position facing the photoreceptor drum 2 by the rotations of the developing roller 13, and the toner is supplied electrostatically onto the electrostatic latent image formed on the surface of the photoreceptor drum 2, thereby developing (visualizing) the electrostatic latent image as a toner image.

Next, the concrete structure of the regulation blade 14 for regulating toner layer thickness will be explained in reference to FIG. 5(*a*) and FIG. 5(*b*).

The regulation blade 14 for regulating toner layer thickness is arranged such that, for example, as a base member 141, such metal as SUS (i.e., electrically conductive base material) may be adopted, and in the region where the electron emitting section 15 is formed, a plurality of aperture 151 are formed as shown in FIG. 5(*a*). Furthermore, a photoelectric surface (photoelectric film) 152 is layered in the area where the electron emitting section 15 is formed. In the structure shown in FIG. 5(*a*), a plurality of small circular holes are formed as the apertures 151. In the present embodiment, the shape of each aperture 151 is not particularly limited, and an aperture in square or triangular shape or an aperture in a slit shape may be adopted.

For the regulation blade 14 for regulating toner layer thickness having the foregoing structure, when irradiating the photoelectric surface 152 of the electron emitting section 15 with an ultraviolet ray, photoelectrons are inducted by the photoelectric effect from the photoelectric surface 152. The photoelectrons are generated mainly from the side of the surface irradiated with an ultraviolet ray, i.e., on the side of the surface facing the ultraviolet irradiator 16. Here, some of the photoelectrons as generated pass through the apertures 151 formed in the electron emitting section 15 and are emitted onto the toner from the side of the surface facing the developing roller 13, thereby charging the toner.

Figure 1:
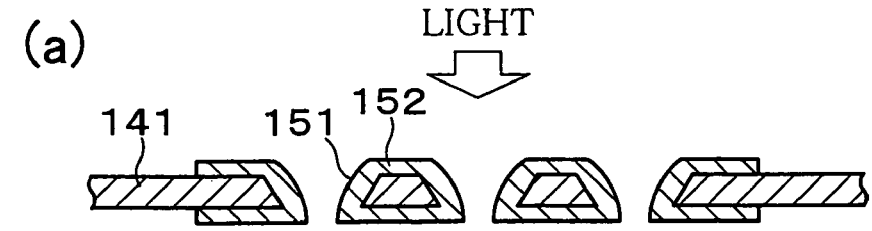
FIG. 1(*a*) through FIG. 1(*e*) are cross-sectional views respectively show shapes of apertures formed in an electron emitting section provided in a developing device in accordance with the first embodiment of the present invention.
Figure 1:
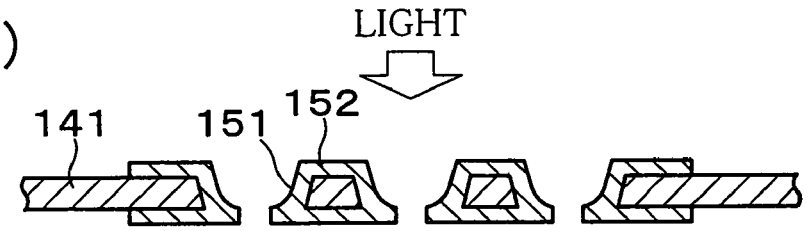
Figure 1:
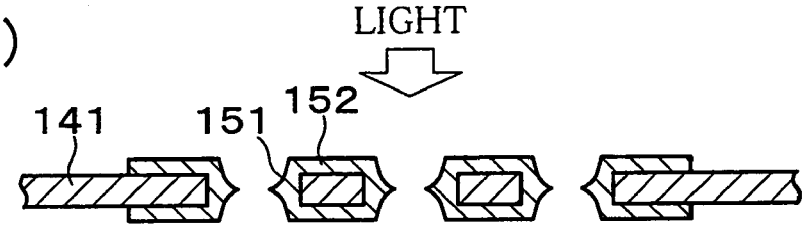
Figure 1:
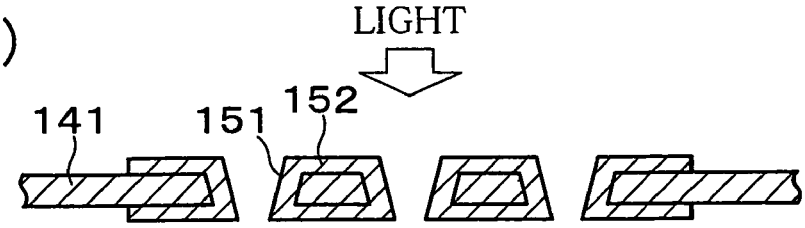
Figure 1:
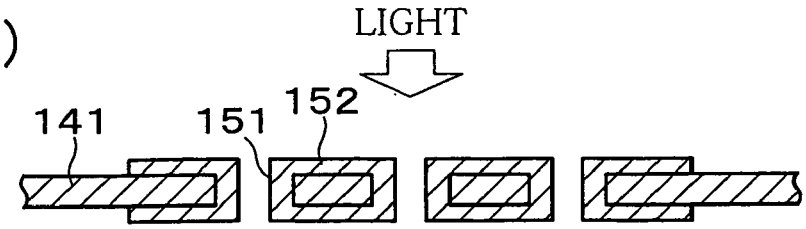

For the shape of apertures 151, a variety of shapes are available. Here, a simulation experiment was performed to obtain an amount of photoelectrons for each shape of the apertures 151. FIG. 1(*a*) through FIG. 1(*e*) are cross-sectional views taken along a line of K-K of FIG. 5(*a*) for respective available shapes of the apertures 151. Specifically, FIGS. 1(*a*) through FIG. 1(*e*) are cross-sectional views cut along a line which is parallel to a through direction of the aperture 151 and which passes through the center of the aperture 151.

For the regulation blade 14 shown in FIG. 5(*a*), each of the apertures 151 is formed by electroforming, and an inner surface of the aperture is curved convexly to be widened outwardly to the side of the ultraviolet irradiator 16 (hereinafter referred to as shape A). For the regulation blade 14 shown in FIG. 5(*b*), each of the apertures 151 is is formed by etching, and an inner surface of each aperture 151 is curved concavely to be widened outwardly to the side of the ultraviolet ray irradiator 16 (hereinafter referred to as shape B). For the regulation blade 14 shown in FIG. 5(*c*), each of the apertures 151 is formed by etching, and an inner surface of the aperture 151 has such a shape that an upper half and a lower half (hereinafter referred to as shape C) are symmetrical about the horizontal line at the center. For the regulation blade 14 shown in FIG. 5(*d*), each of the apertures 151 is formed by the drill hole processing, and an inner surface of each aperture 151 is curved so as to have a cross section of a straight line which is widened to the side of the ultraviolet irradiator 16 (hereinafter referred to as a shape D). For the regulation blade 14 shown in FIG. 5(*e*), an inner surface of the aperture 151 has a cylindrical shape (hereinafter referred to as a shape E).

Next, respective definitions with regard to size of the apertures 151 of FIG. 1(*a*) to FIG. 1(*d*) will be explained in reference to FIG. 2(*a*) through FIG. 2(*d*).

Figure 2:
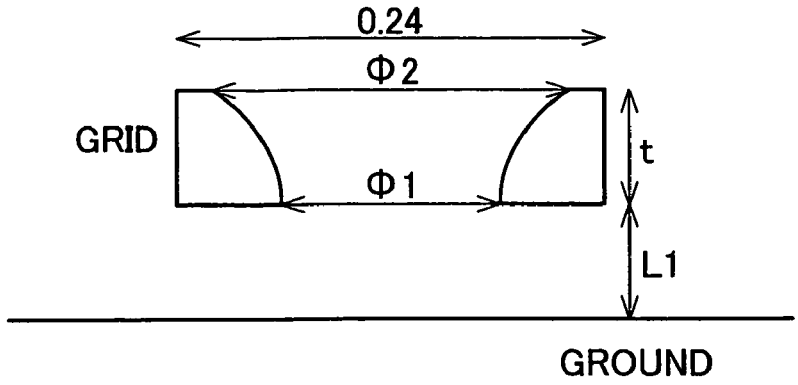
FIG. 2(*a*) through FIG. 2(*d*) are cross-sectional views which explain the size and an applied bias for the respective apertures of FIG. 1(*a*) to FIG. 1(*d*).
Figure 2:
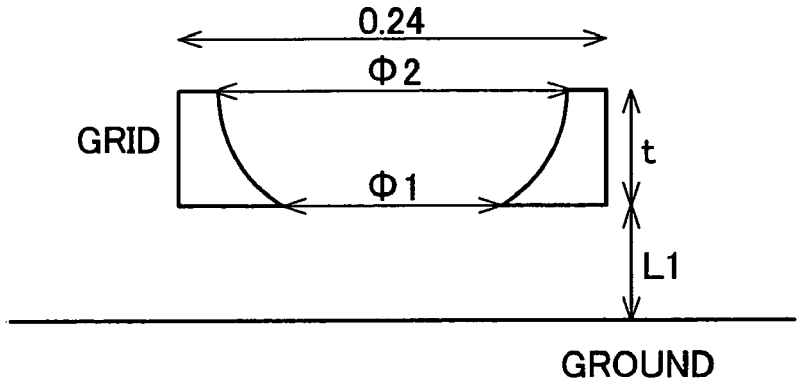
Figure 2:
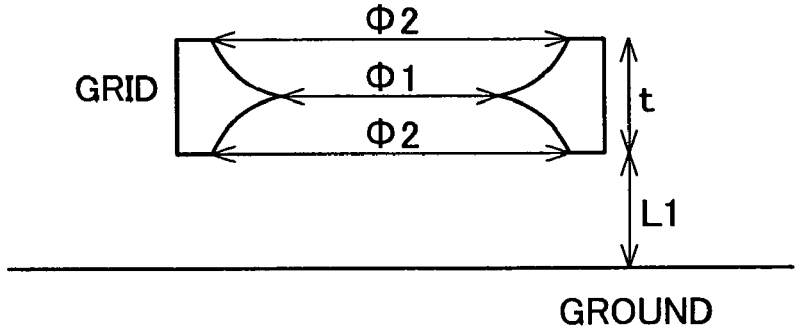
Figure 2:
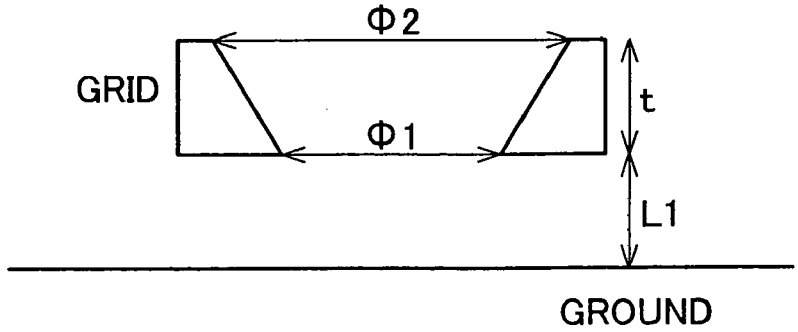

FIG. 2(*a*), FIG. 2(*b*) and FIG. 2(*d*) respectively correspond to the apertures 151 of the shapes A, B and D, wherein an aperture diameter on the side of the developing roller 13 (toner side) is indicated by $\phi 1$, and an aperture diameter on the side of the ultraviolet ray irradiator 16 is indicated by $\phi 2$. FIG. 2(*c*) corresponds to the aperture 151 of the shape C, and respective aperture diameters on the side of the developing roller 13 and the ultraviolet ray irradiator 16 are indicated by $\phi 2$, and the smallest aperture diameter in the inside of the aperture 151 is indicated by $\phi 1$. Incidentally, the depth of the aperture 151, i.e., the distance from one end to the other end of the aperture 151 defines the size of the aperture 151 as measured in the through direction is indicated by "t".

The electron emitting section 15 having formed therein apertures 151 is irradiated with an ultraviolet ray from above in the structure shown in the Figures. Incidentally, each aperture 151 serves as a grid to which a bias voltage V1 is applied. Here, L1 indicates a distance from each aperture 151 to a ground plate having a potential V0 (reference potential). With this structure, the bias is applied across the ground plate and the grid, and electrons as generated are carried onto the ground plate by the electric field generated by the applied bias.

Incidentally, to apply a bias voltage in the developing device of FIG. 4, an electric bias is applied across the electron emitting section 15 and the developing roller 13. Therefore, as shown in FIG. 4, the developing device 10 is arranged such that the regulation blade 14 for regulating toner layer thickness is connected to the bias applying section 19. This bias applying section 19 can be connected to the base member 141 of the regulation blade 14 for regulating toner layer thickness. The bias applying section 20 on the side of the developing roller 13 serves also as the bias applying section for applying developing bias across the photoreceptor drum 2 and the developing roller 13. The bias applying section 19 and the bias applying section 20 both constitute the toner charging section.

Therefore, for the regulation blade 14 for regulating toner layer thickness, as illustrated in FIG. 5(*b*), the insulating layer 17 and a metal layer 18 are formed in the contact region Ws with the developing roller 13 so as to avoid a direct contact between the regulation blade 14 for regulating toner layer thickness and the developing roller 13. For the aperture 151 of the shape E, the insulating layer 17 and the metal layer 18 are shown in FIG. 5(*b*). The same structure of the insulating layer 17 and the metal layer 18 may be adopted for the apertures 151 of other shapes A to D. Namely, the insulating layer 17 is provided for insulating between the developing roller 13 and the base member 141 of the regulation blade 14 for regulating toner layer thickness. This insulating layer 17 may be a fluorocarbon resin layer formed in a thickness of 80 μm on the base member 141.

The metal layer 18 serves to make the contact face with the developing roller 13 to have an appropriate hardness and surface roughness, so that the toner layer can be uniformly formed on the surface of the developing roller 13. For the metal layer 18, for example, a metal layer made of SUS in a thickness of 20 μm.

The structure of insulating between the developing roller and the regulation blade for regulating toner layer thickness, is not particularly limited to the above structure wherein the insulating layer is formed on the side of the regulation blade for regulating toner layer thickness, and it may be arranged so as to form the insulating layer such as a rubber layer on the outer circumferential layer of the developing roller.

According to the foregoing structure of the developing device 10 wherein an electric bias is applied between the regulation blade 14 for regulating toner layer thickness and the developing roller 13, it is possible to improve the charging effect by the following two functions.

For the first function, with an application of the electric bias, an electric field is generated between the regulation blade 14 for regulating toner layer thickness and the developing roller 13. Therefore, on the photoelectric surface 152 of the electron emitting section 15, photoelectrons as generated in a vicinity of the aperture 151 are moved along the electric power line, and pass through the apertures 151 to be attracted to the side of the developing roller 13. Namely, photoelectrons as generated can be used effectively.

Next, as the second function, the photoelectrons as attracted to the side of the developing roller 13 are accelerated by the electric field. Then, when photoelectrons as accelerated hit molecules, the electrons are emitted from the molecules and the electrons are then ionized. In this state, as the electrons emitted from the molecules also have the same function, the number of electrons in the air increase rapidly, and a so-called, electron avalanche appears. Here, the electrons generated from the electron avalanche also serve to charge the toner, and it is therefore possible to significantly improve the charging efficiency.

In the above, explanations have been given for the conditions for the simulation experiment and the structure of the regulation blade 14 for regulating toner layer thickness. The numerical values for the elements explained above with regard to FIG. 2(*a*) to FIG. 2(*d*) are summarized in the Table 1.

TABLE 1

| SHAPE OF CROSS SECTION | PROCESSING METHOD | APERTURE SIZE (mm) | THICKNES t (mm) | GRID BIAS V1(V) | DISTANCE FROM GROUND L1(mm) | PHOTO-ELECTRON AMOUNT (μv/m) |
|---|---|---|---|---|---|---|
| A | ELECTRO-FORMING | Ø1 = 0.14<br>Ø2 = 0.172 | 0.1 | −500 | 0.1 | 599 μv/m |
| B | ETCHING | Ø1 = 0.12<br>Ø2 = 0.23 | 0.1 | −500 | 0.1 | 409 μv/m |
| C | ETCHING | Ø1 = 0.14<br>Ø2 = 0.172 | 0.1 | −500 | 0.1 | 386 μv/m |
| D | DRILL | Ø1 = 0.08<br>Ø2 = 0.166 | 0.1 | −500 | 0.1 | 70.8 μv/m |

Figure 3:
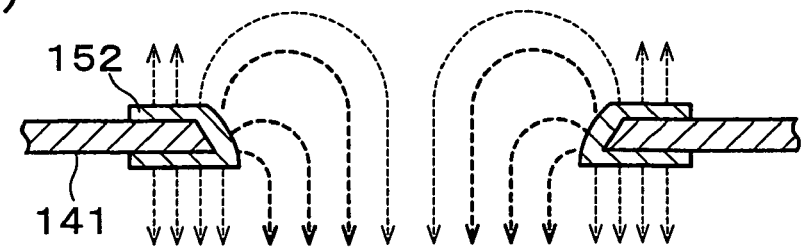
FIG. 3(*a*) through FIG. 3(*e*) are photoelectron distribution maps which show the state of emitting photoelectrons respectively for the apertures of FIG. 1(*a*) through FIG. 1(*e*).
Figure 3:
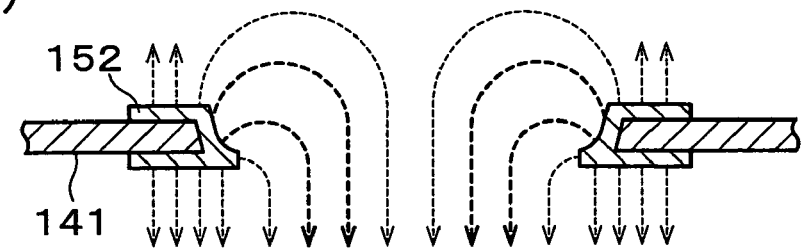
Figure 3:
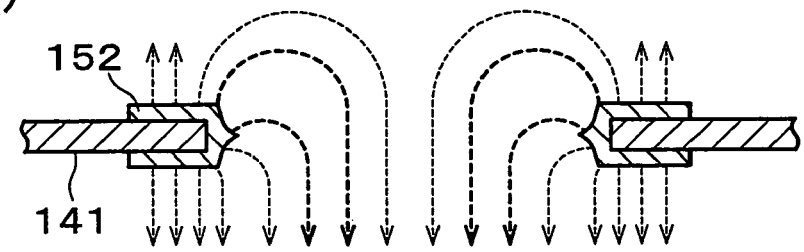
Figure 3:
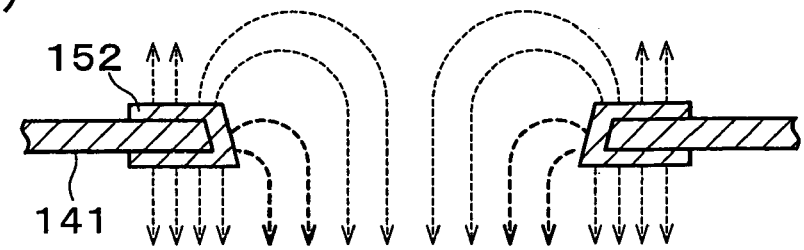
Figure 3:
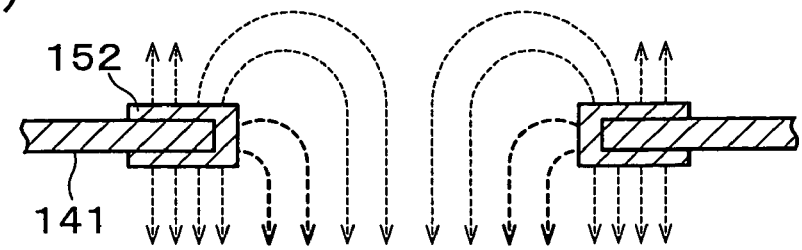

The respective amounts of photoelectrons emitted from the respective apertures 151 and the transfer locus as a result of simulation are shown in FIG. 3(*a*) through FIG. 3(*e*). The locus of the emission of photoelectrons is indicated by a dotted line, and the thicker is the dotted line, the greater is the amount of photoelectrons. Incidentally, an amount of photoelectrons emitted onto the ground plate is confirmed by the measurement as shown in Table 1.

As is clear from the results of the experiment and the typical depictions, the respective diameters indicated by ϕ1 and by ϕ2 are substantially the same for all the shapes A to E of the aperture 151. Therefore, irrespectively of the shape of the aperture 151, it is apparent that a sufficient amount of electrons is not supplied on the side of the developing roller 13 as passed through the apertures 151 when electrons are emitted from the flat parts of the electron emitting section 15 (the areas outside the apertures 151) with an application of an ultraviolet ray onto the flat parts. As described, it is difficult to transfer the electrons as emitted at the flat parts of the electron emitting section 15 to the toner through the apertures 151. Therefore, it can be seen that most of electrons applied to the toner are those emitted from the apertures 151.

Here, the correlation between the inside area of each of the apertures 151 of the shapes A to E and the receiving ratio of the ultraviolet ray as emitted from above is to be considered. Firstly, for the aperture 151 of the shape E, it can be seen that since the inner surface formed is in the direction of irradiating light, the ultraviolet ray is not effectively applied onto the photoelectric surface 152, resulting in low generation rate of electrons. For the aperture 151 of the shape C, it can be seen that since the central portion in the height direction of the inner surface is protruded in a radius direction, the ultraviolet ray as emitted from above is shielded, the light receiving area for receiving ultraviolet ray of the inner surface of the aperture 151 is small, resulting in a smaller amount of electrons as emitted under the condition of the same amount of applied ultraviolet ray. For the apertures 151 of the shape B and D, respective inner surfaces have structures which can effectively receive the ultraviolet ray as emitted. However, the respective amounts of electrons obtained at the ground plates are small as compared to that obtained for the aperture of the shape A as can be seen from Table 1. It can be seen from the above examination that for the apertures 151 of the shape A, the inner surface of each aperture 151 can receive the ultraviolet ray in an efficient manner, and the structure of the aperture of the shape A offers a particularly high generation rate of electrons. For the apertures 151 of the shape A, electrons as emitted with an application of light are directly moved to the toner through the apertures 151, and thus a large amount of electrons can be emitted even with an application of a small amount of light.

As described, the aperture 151 of the shape A has inner surface curved convexly to be widened outwardly to the side of the ultraviolet ray irradiator 16. With this structure, a light receiving area of the inner surface can be increased, and it is therefore possible to emit a larger amount of photoelectrons. Moreover, photoelectrons as emitted from the inner surface, which pass through the apertures 151, can be effectively carried onto the toner. As a result, it is possible to charge the toner under stable conditions, thereby obtaining a desirable image.

According to the foregoing structure, the mechanical charge of the toner such as friction charge as required in the conventional toner charging method can be omitted, and it is therefore possible to charge the toner without an applied stress such as thermal load, etc. It is also possible to sufficiently charge the generally used toner by irradiating the toner with light, other than the toner of the special structure containing photo-chromic compounds, for example. As a result, the developing device 10 offers the effect of preventing toner from deteriorating, i.e., preventing the toner form being damaged, fusing onto the blade, and such developing device 10 which ensures an improved reliability in the developing process is also applicable to the toner whose melting point is lowered for the purpose of reducing fixing energy, or the toner having an increased number of pigments to improve the tinting power.

Incidentally, by forming the inner surface of the aperture 151 in an arc shape for the aperture of the shape A, it is possible to increase the amount of photoelectrons emitted from the inner surface of the aperture 151, and the photoelectrons as emitted can be efficiently carried onto the toner by the electric field as generated from the surrounding. Further, it is possible to adopt the electroforming to form the apertures 151 by setting the radius of the arc to be not less than the distance from one end of the aperture 151 to the other end (thickness t), i.e., not smaller than the size of the aperture 151 in the through direction of the aperture 151.

Incidentally, when forming the apertures 151 by electroforming which is in combination of photolithography and plating, it is possible to form with ease the inner surface of each aperture 151 to have its inner surface curved convexly to be widened outwardly to one side. Furthermore, in the case of forming a plurality of apertures 151 in the electron emitting section 15, it is possible to make the apertures 151 to have respective inner surfaces uniformly curved convexly among the apertures 151, which offers the effect of uniformly charging the toner, thereby obtaining a desirable image.

Incidentally, by adopting a nickel or nickel cobalt alloy for the material of the grid to be laminated onto the base material 144 in the electron emission section 15 of the regulation blade 14 for regulating toner layer thickness, it is possible to process the grid on the base material by electroforming with high precision. Furthermore, the photoelectric surface 152 may be laminated on the material of the grid by plating a metal. It is therefore possible to form the aperture 151, particularly the aperture 151 of the shape A in the above portion by electroforming with high precision. Furthermore, since electroforming can be performed uniformly among the apertures 151, the photoelectrons can be emitted uniformly, thereby forming an image under uniform conditions without irregularity.

The developing device 10 is arranged so as to form the photoelectric surface 152 on the surface facing the ultraviolet ray irradiator 16 of the electron emitting section 15. As in the foregoing structure, by forming the photoelectric surface 152 on the surface facing at least the ultraviolet ray irradiator 16 of the electron emitting section 15, the photoelectric effect can be appreciated efficiently with an application of light from the ultraviolet ray irradiator 16. It is therefore possible to supply sufficient amount of electrons to the toner, thereby charging the toner to a sufficient amount of charge required for forming a desirable image.

For the material of the photoelectric surface 152, any noble metal, a compound of noble metals, a compound of a noble metal and a base metal may be adopted. By adopting the photoelectric surface 152 made of a compound of noble metal and base metal, it is possible to emit a larger amount of electrons by the effect of the base metal of low work function, and it is also possible to emit electrons under stable conditions for a longer period of time by the effect of the noble metal of low reactivity in the atmosphere. For the noble metal, any one of gold, silver and platinum may be adopted, and for the base metals, any one of copper, palladium and nickel may be adopted. A compound of noble metal and base metal is preferable as a noble metal and a base metal can be combined without difficulty, and a molecular bonding can be surely performed which offers such effect that it is less likely that the material changes over time and a larger amount of electrons can be emitted under stable conditions. It is particularly desirable to combine any one of metal, silver, and platinum and any one of copper, palladium and nickel.

The material for the photoelectric surface 152 is not limited to the above material, and any other material which generates the photoelectric effect by receiving light may be adopted. Specifically, other than the above metals, a metal such as Ta, an alloy such as a Mg—Ag alloy, a semiconductor, a conductive polymer, etc., may be adopted. It may be arranged such that the base material 141 of the regulation blade 14 itself serves as the photoelectric surface. Incidentally, it is not necessarily that the photoelectric surfaces 152 be formed on both surfaces of the regulation blade 14 as shown in FIG. 1(*a*), and it is only necessary that the photoelectric surface 152 be formed on one of the surfaces of the regulation blade 14 on the side facing the ultraviolet ray irradiator 16.

Furthermore, light emitted onto the electron emitting section 15 of the present embodiment is not limited to the ultraviolet ray adopted in the above example, and any light such as a visible ray, an X-ray, etc., having a wavelength which inducts the photoelectric effect to the material of the photoelectric surface 152 may be adopted.

As described, according to the developing device 10 in accordance with the present embodiment, the contact pressure as applied by the regulation blade 14 can be significantly reduced as compared to the case of adopting the conventional friction charging system. As a result, it is possible to significantly reduce the contact pressure and the thermal load applied to the toner by the regulation blade 14, thereby preventing the toner form being damaged, fussed onto the regulation blade 14 for regulating toner layer thickness.

Second Embodiment

Figure 6:
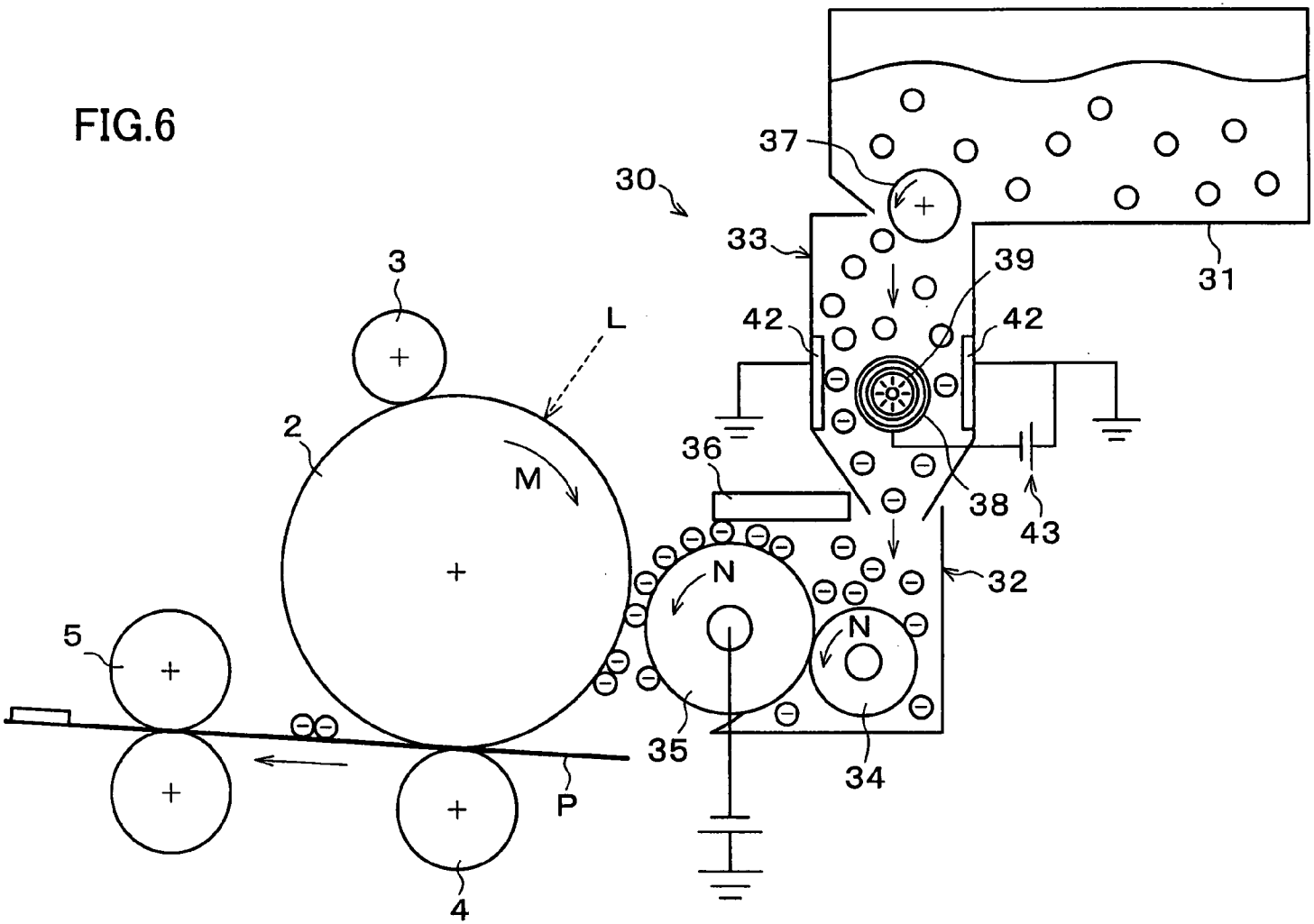
FIG. 6 is a cross-sectional view schematically showing the structure of the image forming apparatus provided with a developing device in accordance with the second embodiment of the present invention.
Figure 7:
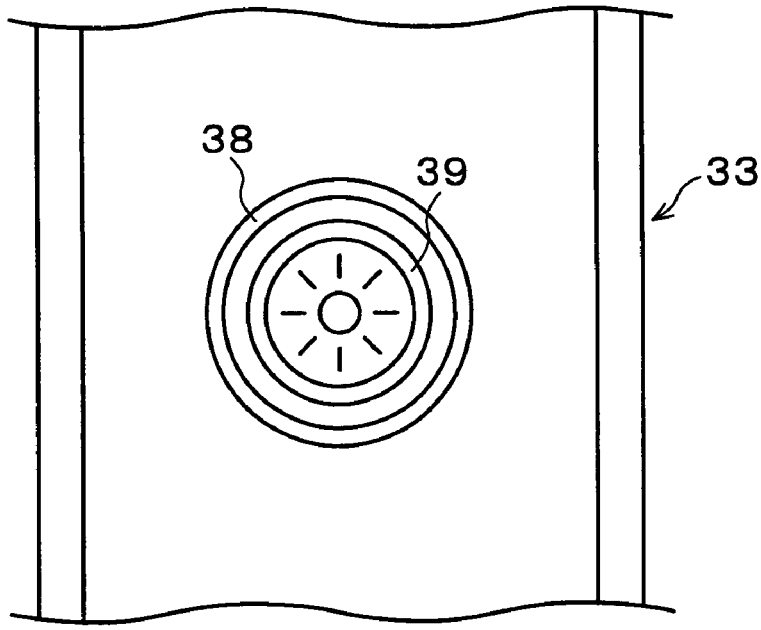
FIG. 7(*a*) and FIG. 7(*b*) show the structure of the toner charging section of FIG. 6 wherein FIG. 7(*a*) is a cross-sectional view of the toner charging section and FIG. 7(*b*) is an expansion plan view of the electron emitting section provided in the toner charging section.
Figure 7:
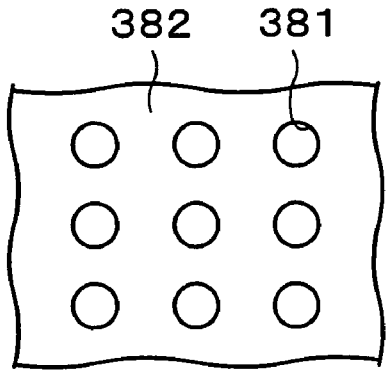

The following descriptions will explain another embodiment of the present invention in reference to FIGS. 6 and 7. For ease of explanation, members (structures) having the same functions as those shown in the drawings pertaining to the first embodiment above will be given the same reference symbols, and explanation thereof will be omitted here.

As illustrated in FIG. 6, a developing device 30 in accordance with the present embodiment is provided so as to face the photoreceptor drum 2. This developing device 10 develops an electrostatic latent image formed on the surface of the photoreceptor drum 2 using developing material (a target material to be charged) made of a non-magnetic single-component toner. The developing device 30 includes a hopper 31, a developer vessel 32 and a charging vessel 33.

As illustrated in FIG. 6, the electro-photographic apparatus (image forming apparatus) provided with the developing device 30 has a processing section which is mainly made up of photoreceptor drum 2, a charging roller 3, an exposing section (not shown) a developing device 30, a transfer-use discharge roller 4, a cleaning section (not shown), a charge removing section (not shown), and a pair of fixing rollers 5.

The developing device 30 includes a hopper 31 provided at the top in the flow of toner, for storing therein the toner before being charged, a developer vessel 32 for supplying toner to the photoreceptor drum 2, a supply roller 34, a developing roller 35 and a regulation blade 36 for regulating toner layer thickness.

The supply roller 34 and the developing roller 35 are provided so as to be rotatable with their outer circumferential surfaces facing one another. The toner stored in the developer vessel 32 is then supplied by the supply roller 34 to the outer circumferential surface of the developing roller 35, and the toner as supplied by the supply roller 34 on the developing roller 35 is carried onto the photoreceptor drum 2. The regulation blade 36 for regulating toner layer thickness is provided on the downstream side of the supply roller 34 and the upstream side of the photoreceptor drum 2 in the rotation direction of the developing roller 35. This regulation blade 36 is in contact with the developing roller 35 to regulate the toner layer formed on the surface of the developing roller 35.

The charging vessel 33 is provided on the downstream side of the hopper 31 and the upstream side of the developer vessel 32, and charges toner to be supplied from the hopper 31 to the developer vessel 32. When the running out of toner in the developer vessel 32 is detected, the hopper 31 makes the toner supply roller 37 rotate to supply toner to the developer vessel 32. In this state, the toner to be supplied from the hopper 31 to the developer vessel 32 always passes through the charging vessel 33 for charging toner.

To realize the above function, the charging vessel 33 is provided therein a toner charging section (charging means) made up of a toner charging roller 38 which emits electrons by inducting their own electrons with an application of light, and a cold cathode glass lamp (light irradiation means) 39 which emits an ultraviolet ray onto the toner charging roller 38. This toner charging section will be explained in detail later.

The developing process in the developing device 30 will be explained in detail later.

When the running out of toner in the developer vessel 32 is detected, the toner supply roller 37 provided in the hopper 31 is rotated to carry the toner, which has not been charged, to the charging vessel 33. For the toner supply roller 37, for example, an expandable urethane roller may be adopted.

In the charging vessel 33, charges are applied to the toner by the toner charging roller 38 and the cold cathode glass lamp 39 which constitute the toner charging section, to charge the toner to a required amount of charge for developing. More specifically, by projecting light from the cold cathode glass lamp 39 onto the electron emitting section (photoelectron emission means) formed on the toner charging roller 38, photoelectrons are inducted from the electron emitting section by the photoelectric effect. The resulting photoelectrons are emitted onto the toner that passes through the charging vessel 33 where the toner is charged to a predetermined amount of charge. Here, it is preferable that the cold cathode glass lamp 39 emits light in sync with the rotations of the toner supply roller 37, as an unnecessary emission of light can be suppressed, and an increase in power consumption can be suppressed.

According to the charging vessel 33 of the foregoing structure, the toner charging section which is provided with the toner charging roller 38 and the cold cathode glass lamp 39 emits photoelectrons as generated by the photoelectric effect onto the toner as passed through the charging vessel 33, thereby charging the toner. It is therefore possible to charge the toner as passed through the charging section 33 which is not in contact with the toner charging section. Namely, it is possible to charge the toner without an applied load.

In order to charge the toner in the foregoing manner, the developing device 30 is arranged so as to include a pair of electrode plates 42 on respective inner faces of the charging vessel 33, wherein these electrode plates 42 and the toner charging roller 38 are connected to the bias application section 43 to apply an electric bias across the toner charging roller 38 and the electrode plate 42. These electrode plates 24 and the bias application section 43 also constitute the toner charging section. Incidentally, this bias application section 43 is connected to the base member of the toner charging roller 38.

According to the foregoing developing device 30 of the present embodiment, with an application of electric bias across the toner charging roller 38 and the electrode plates 42, it is possible to improve the charging effect in the toner charging section by the same function as that explained in the first embodiment. Namely, the electric field as generated with an application of the electric bias offers the effect of realizing improved charging efficiency by increasing the utilization factor of photoelectrons as emitted from the electron emitting section, and the electron avalanche.

As shown in FIG. 7(*a*), the toner charging roller 38 of a cylindrical shape is provided in the charging vessel 33, and further the cold cathode glass lamp 39 is provided in the toner charging roller 38. Here, the shape of the toner charging roller is not limited to the cylindrical shape, and the toner charging roller in a drum shape with a polygonal cross section may be adopted. For the base member of the toner charging roller 38, that adopted in the first embodiment can be adopted. In the region where the electron emitting section is formed, as illustrated in FIG. 7(*b*), a plurality of apertures 381 of the shape A are formed. Further, in the area where the electron emitting section is formed, the photoelectric surface 382 of the same structure as that of the first embodiment is formed.

In the present embodiment, explanations will be given through the case wherein the electron emitting section is formed on the entire surface of the toner charging roller 38. However, the present embodiment is not limited to the foregoing structure, and the electron emitting section may be formed on a part of the toner charging roller 38. Specifically, the electron emitting section may be formed only in the bias application area (the area facing the electrode plates).

In the structure shown in FIG. 7(*b*), a plurality of small circular holes are formed as the apertures 381. In the present embodiment, the shape of each aperture 381 is not particularly limited, and an aperture in square or triangular shape or in a slit shape may be adopted. Incidentally, it is not necessarily that the photoelectron surfaces 382 be formed on both surfaces of the toner charging roller 38, and it is only necessary that the photoelectric surface 382 be formed on the surface on the side facing the cold cathode glass lamp 39 (i.e., the inner surface of the toner charging roller 38).

Furthermore, light emitted onto the electron emitting section of the toner charging roller 38 of the present embodiment is not particularly limited, and any light such as a visible ray, an X-ray, etc., having a wavelength which inducts the photoelectric effect to the material of the photoelectric surface 382 may be adopted.

According to the toner charging section of the foregoing structure, the toner is charged by emitting light from the cold cathode glass lamp 39 to the electron emitting section formed on the toner charging roller 38 from the inner surface side of the toner charging roller 38. Then, the photoelectrons are inducted by the photoelectric effect in the electron emitting section of the toner charging roller 38. As a result, some of the photoelectrons are emitted from the outer circumferential surface of the toner charging roller 38 through the apertures 381 of the electron emitting section, thereby charging toner.

Incidentally, the toner charging section is completely separated from the developing roller 35 (without contact), and the toner layer can be formed without being affected by the surface roughness of the electron emitting section in the toner charging section. It is therefore possible for the toner charging section to charge the toner without an applied load, and the limitation on design due to the surface roughness of the electron emitting section can be avoided.

The toner as charged to a predetermined amount of charge by the toner charging section of the charging vessel 33 is carried to the developer vessel 32. As described, in the developer vessel 32, the toner is sequentially supplied onto the surface of the developing roller 35 by the supply roller 34, and the developing roller 35 rotates with the toner held on the surface thereof is rotated. As a result, the toner as carried by the developing roller 35 is guided to a contact area between the developing roller 35 and the regulation blade 36 for regulating toner layer thickness, and a thickness of the toner layer formed on the developing roller 35 is regulated.

Here, since the toner as guided between the developing roller 35 and the regulation blade 36 for regulating toner layer thickness has already been charged in the charging vessel 33, it is only required for the regulation blade 36 for regulating toner layer thickness to contact with an applied pressure required for regulating the thickness of the toner layer. It is therefore possible to significantly reduce the pressure and the thermal load applied to the toner by the regulation blade 36 for regulating toner layer thickness.

The resulting toner layered on the developing roller 35 is carried to the position facing the photoreceptor drum 2 by the rotations of the developing roller 35, and the toner is then supplied electrostatically onto the electrostatic latent image formed on the surface of the photoreceptor drum 2, thereby developing (visualizing) the electrostatic latent image into a toner image.

According to the developing device 30, the toner charging section is formed in the charging vessel 33 provided between the hopper 31 and the developer vessel 32. However, the present embodiment is not limited to the above structure, and the toner charging section may be provided in any area as long as the function of charging the toner before being layered on the developing roller 35 can be ensured. Specifically, the toner charging section is only required to be provided on the upstream side of the supply roller 34 in order to charge the toner before being layered on the developing roller 35.

As described, according to the foregoing structure wherein the toner is charged by the toner charging section before being layered on the developing roller 35, in the subsequent process of forming the layer, the toner can be stirred, and it is therefore possible to charge the toner to have a uniform amount of charge.

As described, according to the foregoing structure of the developing device 30 of the present embodiment wherein the toner charging section is formed in the charging vessel 33 provided between the hopper 31 and the developer vessel 32, the toner is charged while falling in the floating state within the developing device 30. Namely, the toner to be charged by the toner charging section is relatively dispersed (low cohesiveness), and it is therefore possible to uniformly charge the toner which is falling. As a result, it is possible to more desirably charge the toner in term of uniformity, and the finally obtained charged toner has a still more uniform amount of charge.

The developing section 30 of the present embodiment wherein the toner is charged in the place other than the developing roller, is effective to more uniformly charge the toner, particularly in the case where the toner cannot be charged uniformly when charging the toner on the developing roller, i.e., the toner on the outer surface side of the toner layer formed on the developing roller whose thickness is regulated is charged to a larger amount of charge by receiving a larger number of electrons as emitted from the toner charging section, while the toner on the inner surface side is charged to a smaller amount of charge by receiving a smaller number of electrons.

In each of the foregoing preferred embodiments, explanations have been given through the case of adopting a non-magnetic single component toner; however, the toner applicable to the developing device of the present invention is not intended to be limited to the non-magnetic single component toner, and magnetic toner, two-component developer may be adopted. However, in view of the purpose of the developing device of the present invention, i.e., the thermal load to the toner is reduced to prevent the toner form being damaged, fused to the blade, the present invention is suitably applied to the case of adopting the non-magnetic one component toner, as the problem of the toner being fused onto blade is outstanding when adopting such non-magnetic one component toner.

In the present invention, the toner is charged mainly by the toner charging section which has a characteristic structure of the present invention, and the contact pressure as applied from the blade for regulating toner layer thickness onto the developing roller is set to a minimum required contact pressure for regulating the toner layer. However, the present invention is not limited to the foregoing developing device of the present invention, and the developing device of the present invention may be arranged so as to adopt the toner charging section as a supplemental means for charging the toner. In this structure, the contact pressure as applied from the blade for regulating toner layer thickness onto the developing roller can be set to the maximum contact pressure within the range where the problem of the toner being damaged or fused onto the blade can be avoided. Then, if the toner has not been charged to a required amount of charge by the foregoing charging operation, the toner as charged by the foregoing friction charge is further charged to a required amount of charge by the toner charging section of the present invention.

According to the foregoing structure wherein the toner charging section is used as supplemental means for charging toner, as the required charging power can be reduced, the cost for the toner charging section can be reduced.

Here, in view of the relationship between the charging power of the toner charging section and the contact pressure as applied from the blade for regulating toner layer thickness onto the developing roller, it is only required that the sum of the amount of charge of the toner by the toner charging section and the amount of charge of the toner by the friction charging reaches to a predetermined amount of charge. Namely, the ratio of the amount of charge of the toner by the friction charge to the amount of charge of the toner by the blade for regulating toner layer thickness can be set as desired within the range where the problem of the toner being damaged or fused onto the blade can be avoided.

The light irradiation means of the present invention is not limited to the ultraviolet irradiator 16 or the cold cathode glass lamp 39 adopted in the foregoing embodiments, and any light irradiation means capable of emitting light which inducts the photoelectric effect may be adopted. However, it is preferable to adopt the light irradiation means which does not generate much heat, and, for example, other than the ultraviolet irradiator 16 or the cold cathode glass lamp 39, a xenon lamp is preferable.

As described, the developing device of the present invention which comprises charging means for charging a target material, wherein said target material as charged by said charging means is supplied onto an electrostatic latent image to develop said electrostatic latent image into a toner image, is arranged such that:

said charging means comprises:

light irradiation means for irradiating light; and photoelectron emission means, provided between said light irradiation means and said target material, for emitting photoelectrons when receiving light irradiated from said light irradiation means, wherein a through-type aperture is formed through said photoelectron emission means from the side of said light irradiation means to the side of said target material; and said through-type aperture is shaped to have its inner surface curved convexly to be widened outwardly to the side of said light irradiation means, and photoelectrons are emitted from the inner surface when receiving light from said light irradiation means.

According to the foregoing structure, a light receiving area of the inner surface can be increased, and it is therefore possible to emit a larger amount of photoelectrons. Moreover, photoelectrons as emitted from the inner surface, which pass through the aperture, can be effectively carried onto the target material to be charged. As a result, the target material can be charged uniformly, thereby obtaining a desirable image.

According to the foregoing structure, the mechanical charge of the toner such as friction charge as required in the conventional method can be omitted, and it is therefore possible to charge the toner without an applied stress such as thermal load, etc. It is also possible to sufficiently charge the generally used toner by irradiating the toner with light, other than the toner of the special structure including photochromic compounds.

As a result, the developing device offers the effect of preventing toner from deteriorating, i.e., preventing the toner form being damaged, fused onto the blade, and such developing device which ensures an improved reliability in the developing process is also applicable to the toner whose melting point is lowered for the purpose of reducing fixing energy, or the toner having an increased number of pigments to improve the tinting power.

As described, the developing device of the present invention is further arranged such that:

the inner surface of said through-type aperture is curved convexly to have a cross section of an arc shape when cut along a line which is parallel to a through direction of said through-type aperture and which passes through a center of said through-type aperture.

According to the foregoing structure, a larger amount of photoelectrons can be emitted from the inner surface of the aperture, and by the effect of an electric field generated from surrounding, the photoelectron as emitted can be effectively guided to the target material to be charged.

The developing device of the present invention having the foregoing structure of the present invention may be further arranged such that a radius of said arc of said cross-section is not shorter than a distance from one end of said through-type aperture to the other end of said through-type aperture.

According to the foregoing structure, it is possible to form the aperture by the electroforming.

As described, the developing device having the foregoing structure of the present invention may be further arranged such that:

said through-type aperture is formed by electroforming.

According to the foregoing structure, when forming the apertures by electroforming, it is possible to form the inner surface of each aperture to have its inner surface curved convexly to be widened outwardly to one side. Furthermore, in the case of forming a plurality of apertures in the electron emitting means, it is possible to make the apertures to have respective inner surfaces uniformly curved convexly among the apertures, which offers the effect of uniformly charging the target material, thereby obtaining a desirable image.

The developing device of the present invention having the foregoing structure may be further arranged such that:

said photoelectron emission means is made of nickel or an alloy of nickel and cobalt.

According to the foregoing structure, it is possible to perform the electroforming with high precision by adopting the above material for the photoelectron emission means. Incidentally, by adopting the above material for the aperture, it is possible to perform the electroforming uniformly among the plurality of apertures, and it is therefore possible to uniformly emit photoelectrons, thereby forming a uniform image without having uneven parts.

As described, the developing device having the foregoing structure of the present invention may be arranged so as to further include:

a photoelectric film, which emits photoelectrons when receiving light irradiated from said light irradiation means, is formed at least on one of the surfaces of said photoelectron emission means, on the side facing said light irradiation means.

According to the foregoing structure, with an application of light from the light irradiation means, the photoelectric effect can be appreciated efficiently. It is therefore possible to supply sufficient amount of electrons to the target material, thereby charging the target material to a sufficient amount of charge required for forming a desirable image.

As described, the developing device of the present invention may be further arranged such that:

said photoelectric film is made of noble metal, a compound of noble metals or a compound of noble metal and base metal.

The photoelectric film can be formed by any material of noble metal, a compound of noble metals or a compound of noble metal and base metal. Furthermore, by adopting a compound of noble metal and base metal, it is possible to emit a larger amount of electrons by the effect of the base metal of low work function, and it is also possible to emit electrons under stable conditions for a longer period of time by the effect of the noble metal of low reactivity in the atmosphere.

As described, the developing device of the present invention may be further arranged such that:

said noble metal is gold, silver or platinum, and the base metal is copper, palladium or nickel.

According to the foregoing structure, metals can be combined without difficulty, and a molecular bonding can be surely performed which offers such effect that it is less likely that the material changes over time and a larger amount of electrons can be emitted under stable conditions.

As described, the image forming apparatus of the present invention is provided with any of the foregoing developing device of the present invention.

According to the foregoing structure, with the effect of the developing device which can perform the charging operation under stable condition, a desirable image forming operation can be performed.

As described, the developing device of the present invention which comprises charging means for charging a target material, wherein said target material as charged by said charging means is supplied onto an electrostatic latent image to develop said electrostatic latent image into a toner image, is characterized in that:

said charging means comprises:

light irradiation means for irradiating light; and photoelectron emission means, provided between said light irradiation means and said target material, for emitting photoelectrons when receiving light irradiated from said light irradiation means, wherein a through-type aperture is formed through said photoelectron emission means from the side of said light irradiation means to the side of said target material; and said through-type aperture is shaped to have its inner surface curved convexly to be widened outwardly to the side of said light irradiation means, and photoelectrons are emitted from the inner surface when receiving light from said light irradiation means.

According to the developing device of the present invention, when receiving light from the light irradiation means to the photoelectron emission means, photoelectrons are emitted from the photoelectron emission means. Here, as the through-type aperture is shaped to have its inner surface curved convexly to be widened outwardly to the side of said light irradiation means, a light receiving area of the inner surface can be increased, and it is therefore possible to emit a larger amount of photoelectrons. Moreover, photoelectrons as emitted from the inner surface, which pass through the apertures, can be effectively carried onto the target material to be charged. As a result, the target material can be charged under stable conditions, thereby obtaining a desirable image.

According to the foregoing structure, the mechanical charge of the toner such as friction charge as required in the conventional method can be omitted, and it is therefore possible to charge the toner without an applied stress such as thermal load, etc. It is also possible to sufficiently charge the generally used toner by irradiating the toner with light, other than the toner of the special structure including photochromic compounds.

As a result, the developing device offers the effect of preventing toner from deteriorating, i.e., preventing the toner form being damaged, or fused onto the blade, and such developing device which ensures an improved reliability in the developing process is also applicable to the toner whose melting point is lowered for the purpose of reducing fixing energy, or the toner having an increased number of pigment sections to improve the tinting power.

As described, the developing device of the present invention is further arranged such that:

the inner surface of said through-type aperture is curved convexly to have a cross section of an arc shape when cut along a line which is parallel to a through direction of said through-type aperture and which passes through a center of said through-type aperture.

According to the foregoing structure, as the inner surface of the through-type aperture is curved convexly to have a cross section of an arc shape, a larger amount of photoelectrons can be emitted from the inner surface of the aperture, and by the effect of an electric field generated around the circumference, the photoelectron as emitted can be effectively guided to the target material.

The developing device of the present invention having the foregoing structure may be further arranged such that a radius of said arc of said cross-section is not shorter than a distance from one end of said through-type aperture to the other end of said through-type aperture.

According to the foregoing structure, a radius of said arc of said cross-section is not shorter than a distance from one end of said through-type aperture to the other end of said through-type aperture, i.e., the size of the aperture in the through direction of the through-type aperture, it is possible to form the aperture by the electroforming.

As described, the developing device having the foregoing structure of the present invention may be further arranged such that:

said through-type aperture is formed by electroforming.

When forming the apertures by the electroforming process, it is possible to form the inner surface of each aperture to have its inner surface curved convexly to be widened outwardly to one side without difficulty. Furthermore, in the case of forming a plurality of apertures in the electron emitting means, it is possible to make the apertures to have respective inner surfaces uniformly curved convexly among the apertures, which offers the effect of uniformly charging the target material, thereby obtaining a desirable image.

The developing device of the present invention having the foregoing structure may be further arranged such that:

said photoelectron emission means is made of nickel or an alloy of nickel and cobalt.

According to the foregoing structure, by adopting nickel or an alloy of nickel and cobalt for the material of the photoelectron emission means, it is possible to perform the electroforming with high precision by adopting the above material for the photoelectron emission means. Incidentally, by adopting the above material for the aperture, it is possible to perform the electroforming uniformly among the plurality of apertures, and it is therefore possible to uniformly emit photoelectrons, thereby forming a uniform image without having uneven parts.

As described, the developing device having the foregoing structure of the present invention may be arranged so as to further include:

a photoelectric film, which emits photoelectrons when receiving light irradiated from said light irradiation means, is formed at least on one of the surfaces of said photoelectron emission means, on the side facing said light irradiation means.

According to the foregoing structure, by forming the photoelectric film at least on one of the surfaces of said photoelectron emission means, on the side facing the light irradiation means, with an application of light emitted from the light irradiation means, the photoelectric effect can be appreciated efficiently. It is therefore possible to supply sufficient amount of electrons to the target material, thereby charging the target material to a sufficient amount of charge required for forming a desirable image.

As described, the developing device of the present invention may be further arranged such that:

said photoelectric film is made of noble metal, a compound of noble metals or a compound of noble metal and base metal.

The photoelectric film can be formed by any material of noble metal, a compound of noble metals or a compound of noble metal and base metal. Furthermore, by adopting a compound of noble metal and base metal, it is possible to emit a larger amount of electrons by the effect of the base metal of low work function, and it is also possible to emit electrons under stable conditions for a longer period of time by the effect of the noble metal of low reactivity in the atmosphere.

As described, the developing device of the present invention may be further arranged such that:

said noble metal is gold, silver or platinum, and the base metal is copper, palladium or nickel.

According to the foregoing structure, metals can be combined without difficulty, and a molecular bonding can be surely performed which offers such effect that it is less likely that the material changes over time and a larger amount of electrons can be emitted under stable conditions.

As described, the image forming apparatus of the present invention is provided with any of the foregoing developing device of the present invention.

According to the foregoing structure, with the effect of the developing device which can perform the charging operation under stable condition, a desirable image forming operation can be performed.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

According to the developing device of the present invention, a light receiving area of the inner surface can be increased, and it is therefore possible to emit a larger amount of photoelectrons. Moreover, photoelectrons as emitted from the inner surface, which pass through the aperture, can be effectively carried onto the material to be charged.

As a result, the target material can be charged under stable conditions, thereby obtaining a desirable image. The object of the present invention is to reduce the thermal load applied to the toner and prevent the toner from being damaged, or fused onto the blade, and the effects as achieved from the characteristic structure of the present invention are appreciated particularly in the case of adopting non-magnetic one component toner as the problem of the toner being fused onto the blade is outstanding when adopting such non-magnetic one component toner.

The invention claimed is:

1. A developing device which comprises charging means for charging a target material, wherein said target material as charged by said charging means is supplied onto an electrostatic latent image to develop said electrostatic latent image into a toner image, characterized in that:

said charging means comprises:

light irradiation means for irradiating light; and photoelectron emission means, provided between said light irradiation means and said target material, for emitting photoelectrons when receiving light irradiated from said light irradiation means, wherein a through-type aperture is formed through said photoelectron emission means from the side of said light irradiation means to the side of said target material; and said through-type aperture is shaped to have its inner surface curved convexly to be widened outwardly to the side of said light irradiation means, and photoelectrons are emitted from the inner surface when receiving light from said light irradiation means.

2. The developing device as set forth in claim 1, wherein:

said inner surface of said through-type aperture is curved convexly to have a cross section of an arc shape when cut along a line which is parallel to a through direction of said through-type aperture and which passes through a center of said through-type aperture.

3. The developing device as set forth in claim 2, wherein:

a radius of said arc of said cross-section is not shorter than a distance from one end of said through-type aperture to the other end of said through-type aperture.

4. The developing device as set forth in claim 1, wherein:

said through-type aperture is formed by electroforming.

5. The developing device as set forth in claim 1, wherein:

said photoelectron emission means is made of nickel or an alloy of nickel and cobalt.

6. The developing device as set forth in claim 1, wherein:

a photoelectric film, which emits photoelectrons when receiving light irradiated from said light irradiation means, is formed at least on one of the surfaces of said photoelectron emission means, on the side facing said light irradiation means.

7. The developing device as set forth in claim 6, wherein:

said photoelectric film is made of noble metal, a compound of noble metals or a compound of noble metal and base metal.

8. The developing device as set forth in claim 7, wherein:

said noble metal is gold, silver or platinum, and the base metal is copper, palladium or nickel.

9. The image forming apparatus provided with said developing device of any one of claim 1 to claim 8.

* * * * *